US010597263B2

(12) United States Patent
Zhao et al.

(10) Patent No.: US 10,597,263 B2
(45) Date of Patent: Mar. 24, 2020

(54) TROLLEY FOR A LIFTING DEVICE

(71) Applicant: Konecranes Global Corporation, Hyvinkää (FI)

(72) Inventors: Dingyuan Zhao, Shanghai (CN); Liming Wang, Shanghai (CN); Rui Yao, Shanghai (CN); Gereon Imbusch, Mettmann (DE); Oliver Moll, Solingen (DE); Ahmet Uzun, Wetter (DE); Franz Schulte, Herdecke (DE)

(73) Assignee: Konecranes Global Corporation, Hyvinkää (FI)

( * ) Notice: Subject to any disclaimer, the term of this patent is extended or adjusted under 35 U.S.C. 154(b) by 187 days.

(21) Appl. No.: 15/525,524

(22) PCT Filed: Nov. 27, 2015

(86) PCT No.: PCT/EP2015/077930

§ 371 (c)(1),
(2) Date: May 9, 2017

(87) PCT Pub. No.: WO2016/083579

PCT Pub. Date: Jun. 2, 2016

(65) Prior Publication Data

US 2017/0327351 A1 Nov. 16, 2017

(30) Foreign Application Priority Data

Nov. 28, 2014 (DE) ..... 10 2014 117 561

(51) Int. Cl.
*B66C 11/06* (2006.01)
*B66C 9/14* (2006.01)

(52) U.S. Cl.
CPC ..... *B66C 11/06* (2013.01); *B66C 9/14* (2013.01)

(58) Field of Classification Search
CPC .. B66C 9/14; F16H 7/00; B61B 10/00; B61B 10/02; B61B 10/022
See application file for complete search history.

(56) References Cited

U.S. PATENT DOCUMENTS 2,861,850 A 11/1958 Nyblom
2,997,966 A 8/1961 Chapin et al.
(Continued)

FOREIGN PATENT DOCUMENTS

CN 1600667 A 3/2005
CN 201825653 U 5/2011
(Continued)

OTHER PUBLICATIONS

International Search Report of the International Searching Authority from corresponding Patent Cooperation Treaty (PCT) Application No. PCT/EP2015/077930, indicated completed on Mar. 15, 2016.
(Continued)

*Primary Examiner* — Robert J McCarry, Jr.
(74) *Attorney, Agent, or Firm* — Gardner, Linn, Burkhart & Ondersma LLP

(57) ABSTRACT

A trolley for a lifting device with lifting gear arranged on a support frame and wheels which are mounted on the support frame, via which the trolley can be moved on a support, and at least one first wheel of which is mounted on an axle. The axle can be driven together with the wheel by means of a drive motor. The trolley provides a reliable transmission of drive forces between the wheels and the rail with the drivable first wheel connected to at least one of the other wheels in a driving manner via a flexible drive such that the axle is arranged between the drive motor and the flexible drive and thus the flexible drive is connected downstream of the axle in a driving manner so that the flexible drive can be driven by the axle.

11 Claims, 7 Drawing Sheets

(56) References Cited

U.S. PATENT DOCUMENTS

| | | | | |
|---|---|---|---|---|
| 6,371,031 | B1 | 4/2002 | Muth | |
| 6,988,715 | B2 | 1/2006 | Winter et al. | |
| 7,377,486 | B2 | 5/2008 | Winter et al. | |
| 8,763,992 | B2 | 7/2014 | Imbusch et al. | |
| 8,789,812 | B2 | 7/2014 | Imbusch et al. | |
| 8,789,813 | B2 | 7/2014 | Imbusch et al. | |
| 8,910,923 | B2 | 12/2014 | Moll et al. | |
| 2005/0092201 | A1 | 5/2005 | Winter et al. | |
| 2007/0125258 | A1* | 6/2007 | Waisanen | B66C 9/14 105/163.1 |
| 2013/0009457 | A1* | 1/2013 | Ullein | F16H 7/00 305/127 |

FOREIGN PATENT DOCUMENTS

| | | | |
|---|---|---|---|
| CN | 203173693 | U | 9/2013 |
| DE | 1803471 | A1 | 5/1969 |
| DE | 10345102 | A1 | 5/2005 |
| DE | 102010041894 | A1 | 4/2012 |
| EP | 1892169 | A2 | 2/2008 |
| FR | 1360309 | A | 5/1964 |
| FR | 2642029 | A1 | 7/1990 |
| JP | 2004123293 | A | 4/2004 |
| JP | 2007112526 | A | 5/2007 |

OTHER PUBLICATIONS

Written Opinion of the International Searching Authority from corresponding Patent Cooperation Treaty (PCT) Application No. PCT/EP2015/077930, indicated completed on Jun. 2, 2016.

International Preliminary Examination Report from corresponding Patent Cooperation Treaty (PCT) Application No. PCT/EP2015/077930, dated Oct. 21, 2016.

Preliminary Report on Patentability of the International Searching Authority in English from corresponding Patent Cooperation Treaty (PCT) Application No. PCT/EP2015/077930, completed Oct. 21, 2016.

* cited by examiner 7b
5b
7c
3d
7a 1
7
5a
5d
6b
11b
10
5c
3c
13
5e
12b
9
5a
F
11a
6a
4

5g
11b
10

4
9
2
3b
11a
5h
3a
2a
1
H

TROLLEY FOR A LIFTING DEVICE

CROSS REFERENCE TO RELATED APPLICATION

The present application claims the priority benefits of International Patent Application No. PCT/EP2015/077930, filed on Nov. 27, 2015, and claims benefit of DE 10 2014 117 561.1, filed on Nov. 28, 2014.

BACKGROUND OF THE INVENTION

The invention relates to a trolley for lifting gear, comprising a lifting mechanism arranged on a support frame and comprising running wheels which are mounted on the support frame and via which the trolley can be moved on a beam and of which at least one first running wheel is mounted on an axle and the axle can be driven together with the running wheel by means of a drive motor.

German laid-open document DE 103 45 102 A1 discloses a trolley of a crane which can be moved via a total of four running wheels on and along a beam. The running wheels are typically arranged, as seen from above onto the beam, in the corners of a notional rectangle. One of the four running wheels is electrically driven. In order to transmit the drive forces of the driven running wheel in a reliable manner to the beam which also serves as a travel rail, a pair of resiliently biased friction rollers are provided, via which the driven running wheel is pulled onto the travel rail. As an alternative, it is described therein that a plurality of the running wheels can be driven via the one traction drive or in each case separate traction drives.

German laid-open document DE 1 803 471 A discloses a crane, on the delivery carriage of which a trolley which is driven by means of a linear motor can be moved. The moving part of the linear motor comprises a traction mechanism which is designed as a belt or chain and is driven by the stationary part of the linear motor formed by induction coils. The traction mechanism of the linear motor drives two wheel axles together with running wheels arranged at both ends on each wheel axle. The traction mechanism is part of the linear motor and is drivingly connected upstream of the two wheel axles, so that both wheel axles are driven together by the traction mechanism.

FR 1 360 309 A describes a traction drive for the crane girder of a bridge crane whose running wheels are drivingly connected by means of a chain-like traction mechanism.

Moreover, German laid-open document DE 10 2010 041 894 A1 discloses a delivery apparatus comprising a trolley whose traction drive has a belt drive.

SUMMARY OF THE INVENTION

The present invention provides a trolley of a crane which ensures a reliable transmission of the drive forces between the running wheel and the travel rail.

In accordance with an embodiment of the invention, in the case of a trolley for lifting gear, comprising a lifting mechanism arranged on a support frame and comprising running wheels which are mounted on the support frame and via which the trolley can be moved on a beam and of which at least one first running wheel is mounted on an axle and the axle can be driven together with the running wheel by means of a drive motor, a reliable transmission of the drive forces between the running wheel and the travel rail is ensured by virtue of the fact that the drivable first running wheel is drivingly connected to at least one of the further running wheels via a traction mechanism such that the axle is arranged between the drive motor and the traction mechanism and thus the traction mechanism is drivingly connected downstream of the axle, so that the traction mechanism can be driven by the axle. This embodiment has a simple structural design and, in the case of relatively large spaced intervals between the running wheels, also renders it possible to drivingly connect said wheels in a simple manner and to transmit the corresponding drive forces. The traction mechanism, when designed in a frictionally engaged manner, also prevents any overloading of the running gear unit because the running gear unit will simply slip when overloaded. By driving the trolley by means of at least two running wheels, the drive forces are transmitted more reliably to the travel rail. Therefore, a uniform movement of the trolley can be achieved even in rough operating situations. Slipping of the running wheels and therefore wear thereof are also minimized. Furthermore, the traction mechanism increases the smooth running of the driven running wheels.

In structural terms, it is particularly simple to use the traction mechanism if the driven first running wheel and the at least one of the further running wheels are arranged, as seen in the direction of travel of the trolley, one behind the other and on a common side of the beam.

Provision is made that the second running wheel can be driven by the driven first running wheel via the traction mechanism. As a result, sufficient traction is achieved for the majority of operating scenarios.

In an embodiment, the traction mechanism is designed as a V-ribbed belt. The V-ribbed belt allows the drive forces to be transmitted in a reliable manner and with almost no slip.

In structural terms, provision is made that in each case a traction mechanism disk is drivingly allocated to the driven running wheels and the traction mechanism rotates about the traction mechanism disks.

A particularly compact and simple design is achieved by virtue of the fact that the driven running wheels and the associated traction mechanism disk are formed in each case in one piece. In this case, it is particularly advantageous that the traction mechanism disk adjoins a respective running surface of the driven running wheels.

In an alternative embodiment, provision is made that the driven running wheels and the associated traction mechanism disk are drivingly connected to one another in each case by means of a motor shaft or an axle. The traction mechanism thus extends on the rear side of the first longitudinal beam and thus on the side thereof facing away from the beam. As a result, the traction mechanism drive is protected against any possible soiling caused by the movement of the trolley on the beam.

In order to increase the traction of the driven running wheels, said wheels are acted upon via resiliently biased friction rollers in the direction of the beam serving as the travel rail.

The invention will be explained in greater detail hereinafter with reference to several exemplified embodiments which are illustrated in the drawings.

DESCRIPTION OF THE PREFERRED EMBODIMENTS

Figure 1:
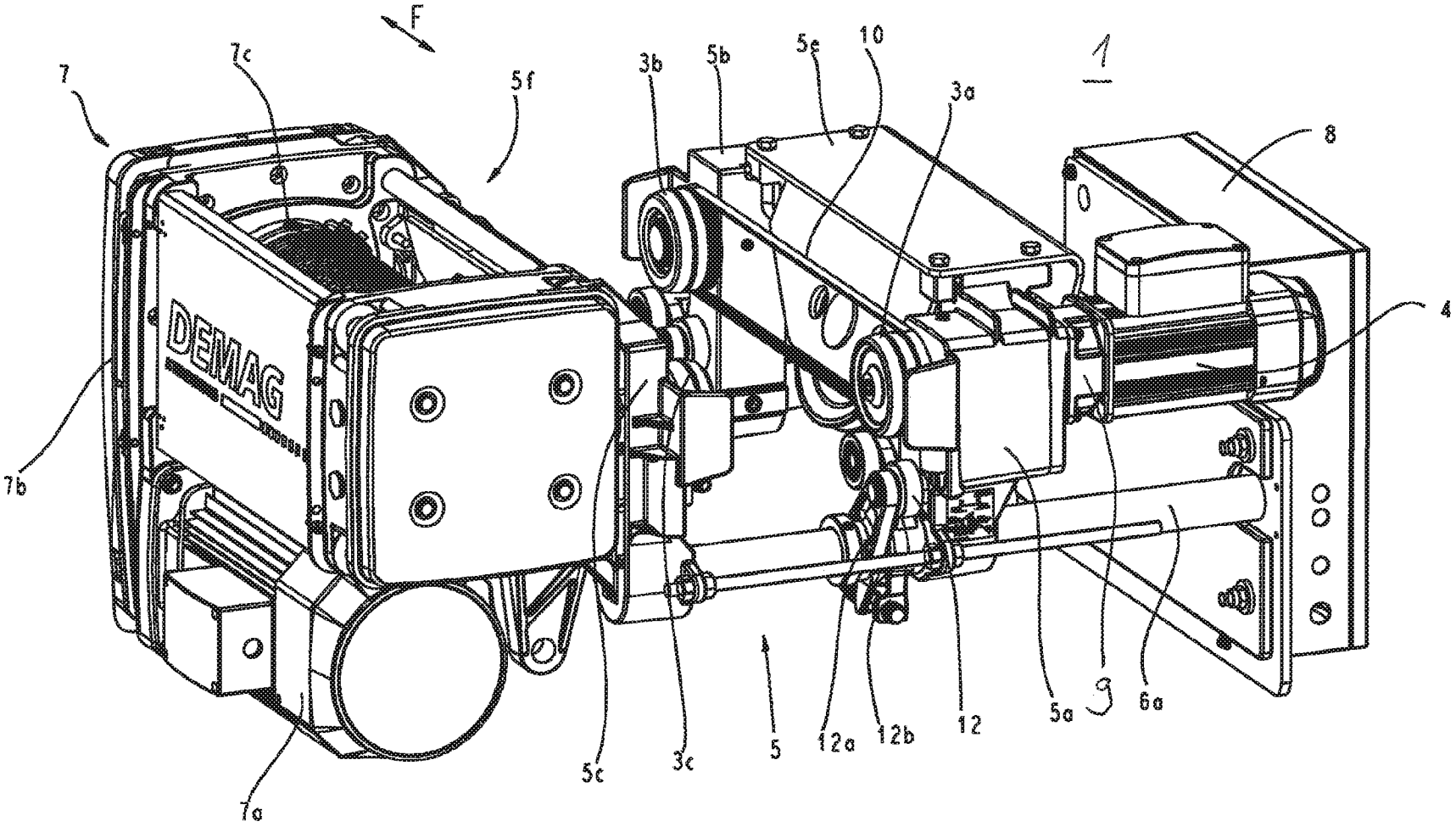
FIG. 1 shows a perspective view of a trolley of a crane.

FIG. 1 shows a perspective view of a trolley 1 of a bridge crane, not illustrated. For reasons of clarity, a beam 2 (see FIG. 3), which typically extends horizontally and on which the trolley moves, and a load hook are not illustrated. The trolley 1 can be moved along the beam 2, in particular in the longitudinal direction thereof, via a total of four running wheels 3*a*, 3*b*, 3*c* and 3*d* each having an identical diameter. The running wheels 3*a*, 3*b*, 3*c* and 3*d* are typically arranged, as seen from above onto the beam 2, in the corners of a notional rectangle (see also FIG. 2). Of the four running wheels 3*a*, 3*b*, 3*c* and 3*d*, a first running wheel 3*a* and a second running wheel 3*b* are driven together by means of an electric drive motor 4. As seen in the direction of travel F of the trolley 1 and thus in the longitudinal direction of the beam 2, the first running wheel 3*a* and the second running wheel 3*b* are arranged at a spaced interval with respect to one another and one behind the other. The third and fourth running wheels 3*c* and 3*d* which are opposite the first and second running wheels 3*a* and 3*b* respectively are not driven and are freely rotatable. All of the running wheels 3*a*, 3*b*, 3*c* and 3*d* are mounted on a support frame 5 of the trolley 1 so as to be able to rotate about horizontal and mutually parallel or mutually aligned axes. The axes extend horizontally under the assumption that the running surfaces of the beam 2 extend horizontally.

The intrinsically bending-resistant support frame 5 of the trolley 1 is composed of a plurality of components which will be explained in greater detail hereinafter. As seen in the direction of travel F of the trolley 1 and thus in the longitudinal direction of the beam 2, the support frame 5 is formed in a u-shaped manner. In order to mount the four running wheels 3*a*, 3*b*, 3*c* and 3*d* in the manner of a vehicle, the support frame 5 has four cuboidal bearing brackets 5*a*, 5*b*, 5*c* and 5*d*, of which in each case the first and third bearing brackets 5*a* and 5*c* which are opposite in relation to the beam 2 are interconnected at their lower ends to a first transverse beam 6*a* and the opposite second and fourth bearing brackets 5*b* and 5*d* are connected at their lower ends to a second transverse beam 6*b* (see FIG. 2). The two u-shaped front and rear bearing parts thus produced are then connected via first and second longitudinal beams 5*e* and 5*f*, which extend in the direction of travel F of the trolley 1, to form the support frame 5. In this case, the first longitudinal beam 5*e* connects the first and second bearing brackets 5*a* and 5*b* and the second longitudinal beam 5*f* connects the third and fourth bearing brackets 5*c* and 5*d*. In the present exemplified embodiment, a lifting mechanism 7 which is arranged on the support frame 5 of the trolley 1 assumes the function of the second longitudinal beam 5*f*. The first and second transverse beams 6*a* and 6*b* are designed as pipes, on which the first and second bearing brackets 5*a* and 5*b* can be displaced and fixed, in order to adapt the trolley 1 to the width of the beam 2 and mount it thereon.

Furthermore, it is evident in FIG. 1 that the first running wheel 3*a* mounted on the first bearing bracket 5*a* is driven by an electric drive motor 4 which is flange-mounted on the end of the first bearing bracket 5*a* opposite the first running wheel 3*a* via a travel gear mechanism 9. The axes of rotation of the travel motor 4 and of the first running wheel 3*a* extend in parallel with one another or are aligned with one another.

The lifting mechanism 7 which can be moved by means of the trolley 1 in the direction of travel F thereof and thus in the longitudinal direction of the beam 2 typically consists of an electric lifting motor 7*a* which acts upon a cable drum 7*c* via a lifting gear mechanism and is designed preferably as a cable winch. On the whole, the lifting mechanism 7 has a compact c-shaped form. In this case, the lifting motor 7*a* is arranged below the cable drum 7*c*, wherein the axes of rotation thereof extend in parallel and in the direction of travel F. The lifting gear mechanism 7*b* connects the lifting motor 7*a* and the cable drum 7*c* to one another at a rear end as seen in the direction of travel F. If the beam 2 is e.g. part of a bridge crane, the beam 2 can be moved transversely with respect to its longitudinal extension by means of traction drives arranged at both ends on the beam 2. As a result, the trolley 1 with the lifting mechanism 7 arranged thereon can then also be additionally moved transversely with respect to the longitudinal direction of the beam 2. Therefore, a movement of the lifting mechanism in the longitudinal direction of the beam 2 by means of the trolley 1 is independent of any additionally possible movement transversely with respect to the longitudinal direction of the beam 2 by means of the possible traction drives for the beam 2.

In order to drive not only the first running wheel 3*a* but also the second running wheel 3*b*, the first running wheel 3*a* and the second running wheel 3*b* are driving connected to one another by means of a traction mechanism 10. The traction mechanism 10 is guided circumferentially around a first traction mechanism disk 11*a* and a second traction mechanism disk 11*b* which are each allocated to the first and second running wheels 3*a* and 3*b* and have the same effective diameter. In other words, the traction mechanism 10 is arranged outside of the travel motor 4 and therefore is drivingly connected downstream of the travel motor 4 and the axle, on which the driven first running wheel 3*a* is mounted, so that the traction mechanism 10 is driven by the corresponding axle. Therefore, the traction mechanism 10 does not drive the axle of the first running wheel 3*a* but rather is driven thereby. Therefore, by means of the driving connection, the traction mechanism 10 only drives the axle on which the second running wheel 3*b* is mounted. The first and second traction mechanism disks 11*a* and 11*b* can be mounted on the axles of the first and second running wheels 3*a* and 3*b* and therefore can be arranged adjacent to the running wheels 3*a* and 3*b* or remote therefrom or can be fastened directly to the first and the second running wheels 3*a* and 3*b*. In the illustrated exemplified embodiment, the first and second traction mechanism disks 11*a* and 11*b* are each an integral component of the first and second running wheels 3*a* and 3*b* respectively. The traction mechanism 10 is designed preferably as a V-ribbed belt and the first and second traction mechanism disks 11*a* and 11*b* are designed correspondingly as profiled V-ribbed belt disks. It is also feasible to use, as the traction mechanism 10, form-fitting traction mechanisms such as toothed belts and roller chains or frictionally engaged traction mechanisms such as V-belts, flat belts and circular belts. The first and second traction mechanism disks 11*a* and 11*b* are then designed in a complementary manner with respect to the traction mechanism 10 selected in each case.

The first and second transverse beams 6*a* and 6*b* are also extended beyond the first and third bearing brackets 5*a* and 5*c*, in order to accommodate, at their end opposite the lifting mechanism 7, an electric connection box 8.

FIG. 1 shows a trolley which is designed as a so-called monorail trolley having a low installation height. This design is characterised by its compact and space-saving construction. In this case, the lifting mechanism 7 is arranged laterally next to the beam 2 as seen in the direction of travel F, so that the load hook 13 (see FIG. 3) can be raised as high as possible underneath the beam 2. This causes, in relation to the centre of the beam 2, a lateral shift of the centre of mass of the lifting mechanism 7. As a result, when the trolley 1 is moving without a payload there is the risk that the driven first and second running wheels 3*a* and 3*b* which are opposite the lifting mechanism 7 will be relieved of loading, lift off and/or slip. A comparable operating situation can result from an oscillating load suspended from the load hook. In order to avoid the relieving of loading, lift-off and slip, the first and second running wheels 3*a* and 3*b* are each allocated pairs of resiliently biased friction rollers 12 which pull the first and second running wheels 3*a* and 3*b* onto the beam 2 serving as a travel rail 2*a*. The axles of the four friction rollers 12 are oriented in parallel with the axles of the four running wheels 3*a*, 3*b*, 3*c* and 3*d*. Each of the total of four friction rollers 12 is mounted on the first transverse beam 6*a* or second transverse beam 6*b* so as to be pivotable via a lever 12*a*. The levers 12*a* of one pair of the friction rollers 12 are held by means of a common adjustable spring element 12*b* in a biased v-shaped position, in which the friction rollers 12 are pressed from below against the beam 2 serving as the travel rail 2*a*. In this case, as seen transversely with respect to the direction of travel F, the friction rollers 12 are arranged in front of and behind the respective first or second running wheel 3*a* and 3*b* and, as seen in the direction of travel, are arranged below the respective first or second running wheel 3*a* and 3*b*. It is also possible to provide a counterweight instead of the friction rollers 12 and to balance out the trolley 1 accordingly hereby.

Figure 2:
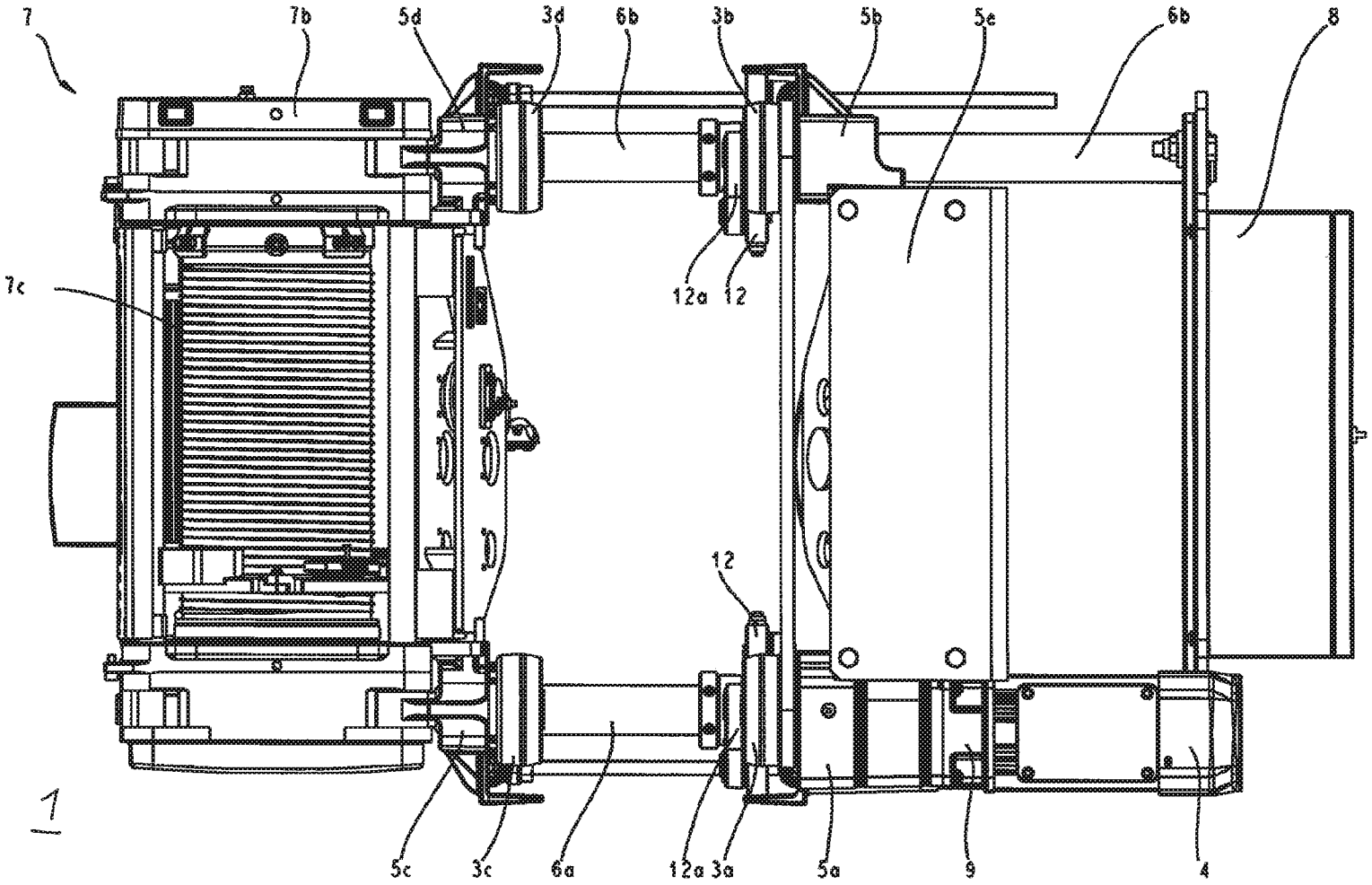
FIG. 2 shows a plan view of the trolley shown in FIG. 1 but without a traction mechanism.

FIG. 2 shows a plan view of the trolley 1 shown in FIG. 1. However, for reasons of clarity the traction mechanism 10 between the first and second running wheels 3*a* and 3*b* has not been illustrated. This plan view shows the vehicle-like arrangement of the four running wheels 3*a*, 3*b*, 3*c* and 3*d* in the corner points of a notional rectangle.

Figure 3:
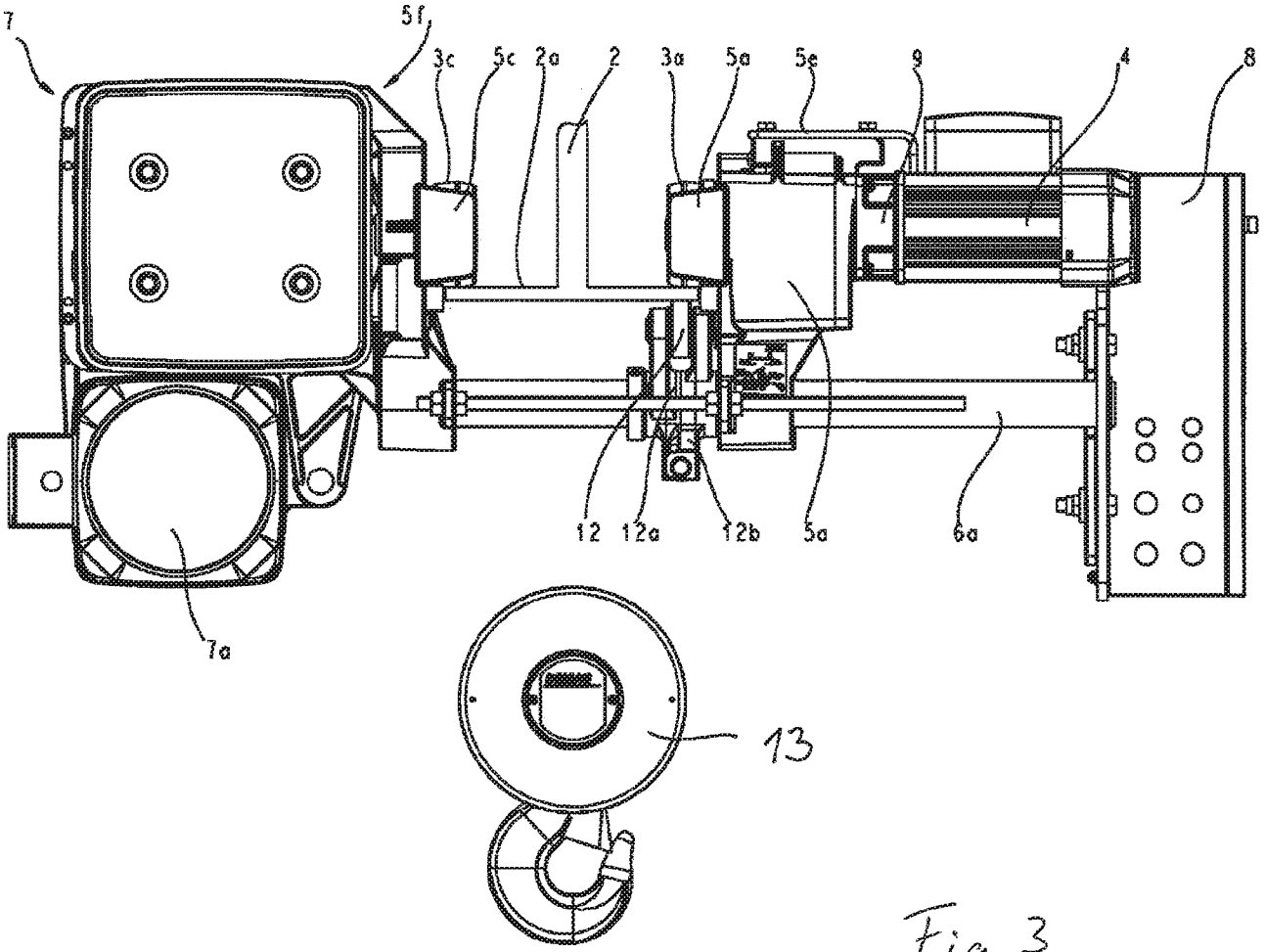
FIG. 3 shows a front view of the trolley shown in FIG. 1.

FIG. 3 shows a front view of the trolley 1 shown in FIG. 1, including in addition the beam 2 and a load hook 13. However, for reasons of clarity the lifting cable has been omitted. The beam 2 is designed as an I-beam whose horizontal lower flange serves as a travel rail 2*a*. The running wheels 3*a*, 3*b*, 3*c* and 3*d* roll on the travel rail 2*a* and on the travel rail 2*a* the friction rollers 12 rolling at this location are pressed against the underside thereof. The beam 2 can also be designed as a box beam which has a cross-section with opposite travel rails 2*a* for the running wheels 3*a*, 3*b*, 3*c* and 3*d* and the friction rollers 12.

Figure 4:
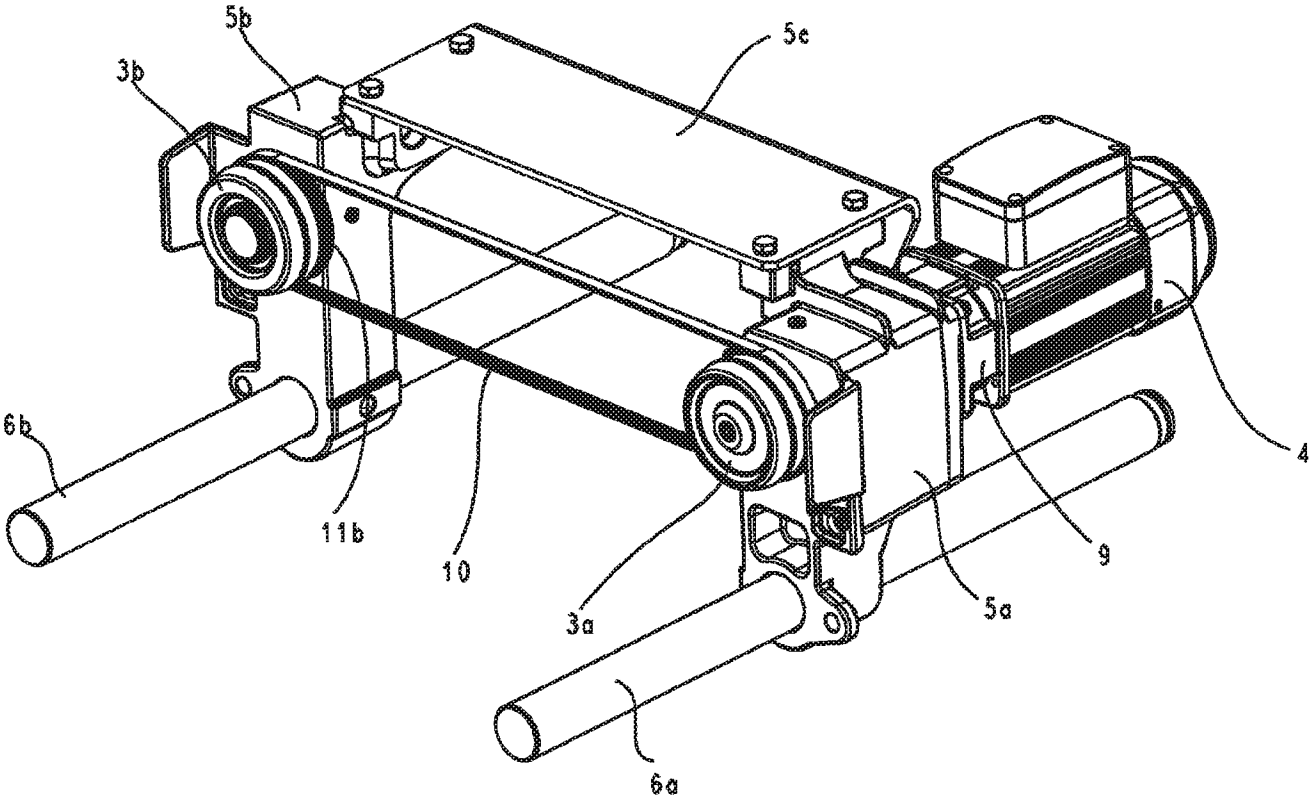
FIG. 4 shows a detailed view of the trolley shown in FIG. 1.

A detailed view of the trolley 1 shown in FIG. 1 from the region of the traction mechanism 10 is illustrated in FIG. 4. The traction mechanism 10 drives the second running wheel 3*b* via the first running wheel 3*a*. It is self-evident that an adjustable tensioning apparatus, not illustrated, must be provided for the traction mechanism 10. An adjustable roller is feasible for this purpose.

Figure 5B:
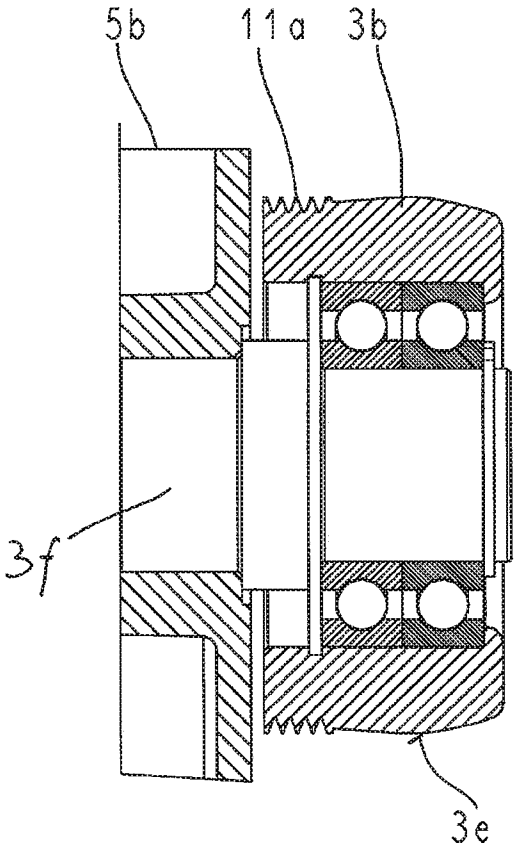
FIG. 5*b* shows a sectional view of a driven running wheel.
Figure 5A:
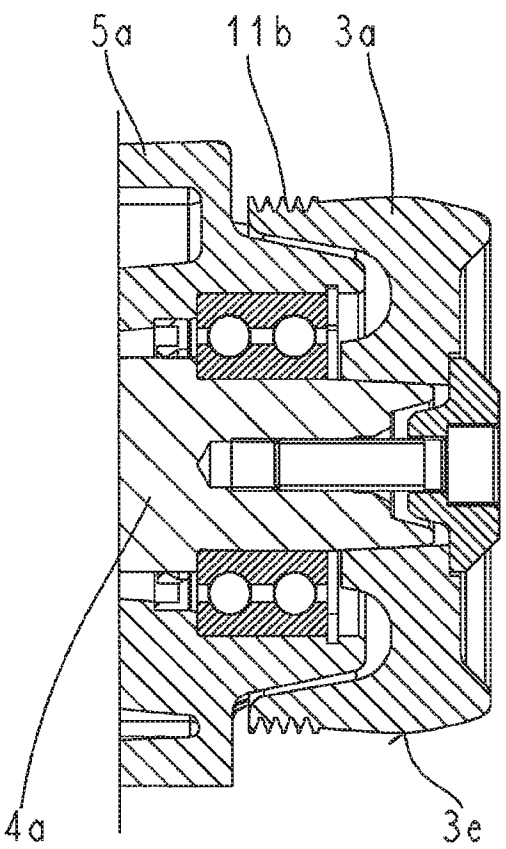
FIG. 5*a* shows a sectional view of a driving running wheel.

FIG. 5*a* shows a sectional view of the driving first running wheel 3*a*. The running wheel 3*a* typically has a circumferential running surface 3*e*, with which the trolley 1 is in contact on the beam 2. Following on adjacent to the running surface 3*e*, and in particular on the side thereof facing towards the bearing bracket 5*a*, is the traction mechanism disk 11*a* in the form of a broadened running surface 3*e*. When the traction mechanism 10 is designed as a V-ribbed belt, corresponding v-shaped grooves are incorporated into the circumferential surface of the traction mechanism disk 11*a* in a complementary configuration to the number and shape of the ribs on the V-ribbed belt. The first traction mechanism disk 11*a* and the first running wheel 3*a* are thus formed in one piece.

FIG. 5*b* illustrates a sectional view of the driven second running wheel 3*b*, showing an embodiment of the second traction mechanism disk 11*b* corresponding to FIG. 5. FIGS. 5*a* and 5*b* differ in terms of the bearing support of the running wheels 3*a*, 3*b* because the first running wheel 3*a* is driven by a motor shaft 4*a* and the second running wheel 3*b* rotates freely about an axle 3*f*. The term "motor shaft 4*a*" is understood in this case to mean the output shaft of the gear mechanism 9.

Figure 6:
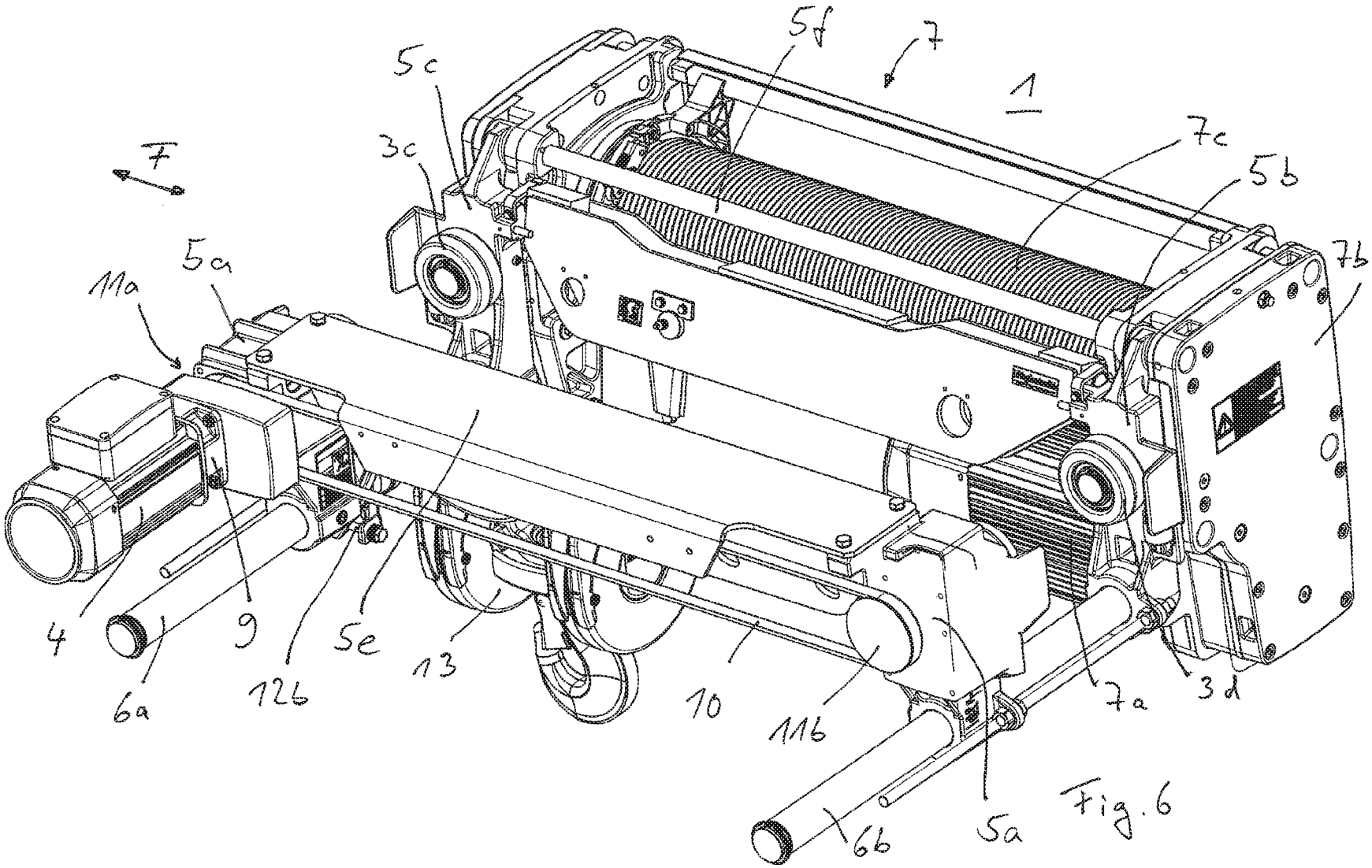
FIG. 6 shows a perspective view of a trolley of a crane in a second embodiment.

FIG. 6 shows a perspective view of a trolley 1 of a crane in a second embodiment. This embodiment corresponds substantially to the previously described trolley 1, so that reference is made to the description relating to FIGS. 1 to 3. This embodiment differs from the previously described embodiment in terms of the arrangement of the first and second traction mechanism disks 11*a*, 11 *b* on the rear side of the first and second bearing bracket 5*a*, 5*b*. In this case, the term "rear side" is understood to be the side of the bearing brackets 5*a*, 5*b* facing away from the beam 2. The first and second traction mechanism disks 11*a*, 11 *b* are thus mounted on the motor shaft 4*a* and the axle 3*f*. Accordingly, the first and second traction mechanism disks 11*a*, 11 *b* of the first and second running wheels 3*a*, 3*b* are mounted separately on the motor shaft 4*a* and the axle 3*f*. The traction mechanism 10 thus extends on the rear side of the first longitudinal beam 5*e*, the first and second bearing brackets 5*a*, 5*b* and is thus protected against possible soiling caused by the movement of the trolley 1 on the beam 2.

Figure 7:
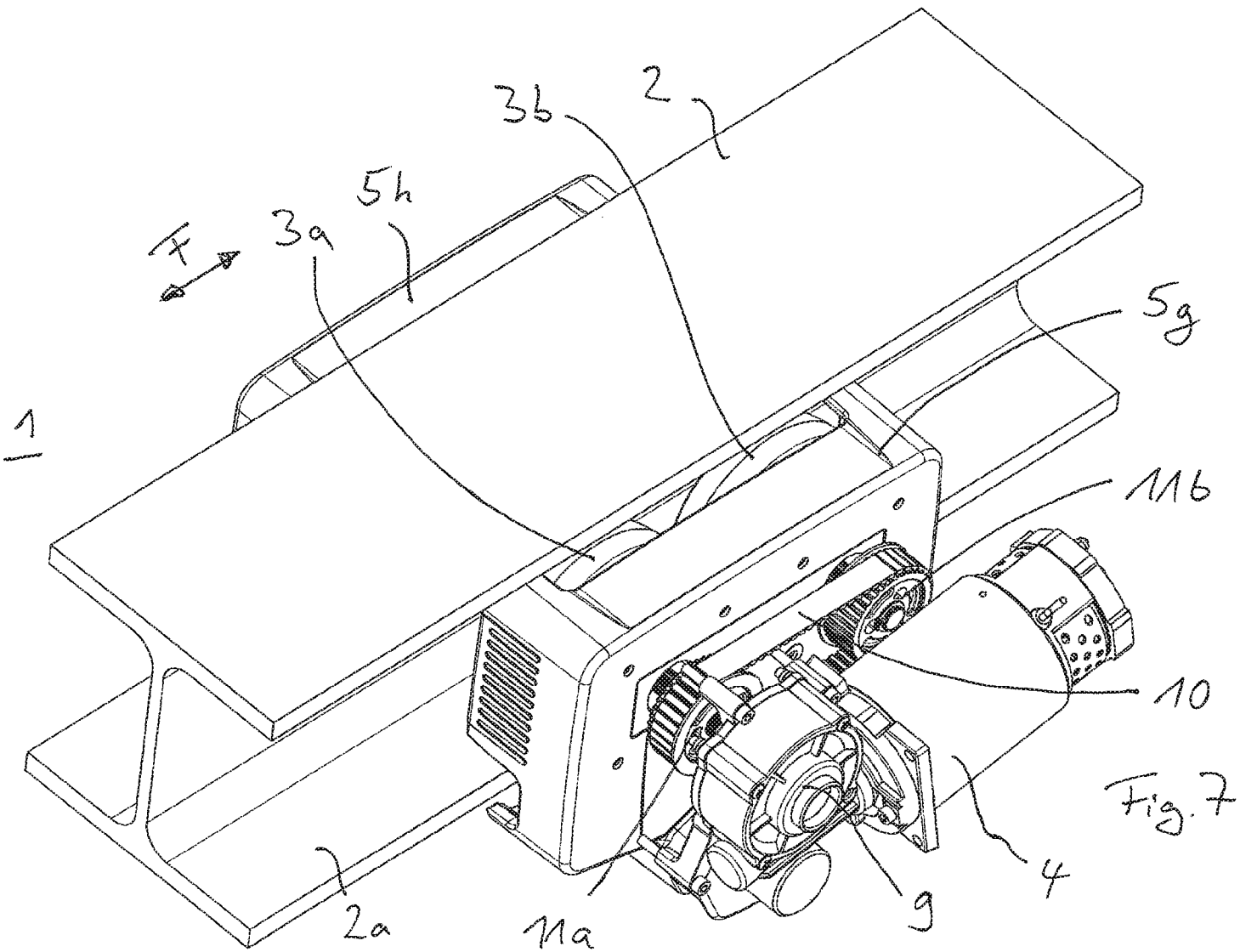
FIG. 7 shows a perspective view of a trolley in a third embodiment for lifting gear designed as a chain hoist.

FIG. 7 shows a perspective view of a trolley 1 in a third embodiment for lifting gear which is designed as a chain hoist and which for reasons of clarity is not illustrated. In relation to the essential components, the embodiment of the trolley 1 is comparable to the two previously described trolleys 1. The essential difference resides in a shorter wheel base of the four running wheels 3*a*, 3*b*, 3*c* and 3*d*, of which only the first and second running wheels 3*a*, 3*b* can be seen. The opposite third and fourth running wheels 3*c*, 3*d* are concealed by the beam 2 which serves as a travel rail 2*a*. The short wheel base also permits a more compact design of the support frame 5 which, as seen in the direction of travel F, has on the right side of the beam 2 a first side part 5*g* instead of a first bearing bracket, a second bearing bracket and a first longitudinal beam, and as seen in the direction of travel F, has on the left side of the beam 2 a second side part 5*h* instead of a third bearing bracket, a fourth bearing bracket and a second longitudinal beam. The first and second side parts 5*g*, 5*h* serve to provide bearing support for the four running wheels 3*a*, 3*b*, 3*c* and 3*d* and are connected at their lower ends via a single pipe-shaped or rod-shaped transverse beam 6*a* to form the u-shaped support frame 5. The trolley 1 shown in FIG. 6 is also defined as a lower flange running gear unit because the four running wheels 3*a*, 3*b*, 3*c* and 3*d* thereof roll on the lower flange of the beam 2 serving as a travel rail 2*a*. Suspended centrally from the transverse beam 6*a* is then the chain hoist which can be moved along the beam by means of the trolley 1.

In the case of this third embodiment, the first and second running wheels 3*a*, 3*b* are driven together by means of an electric drive motor 4. The drive motor 4 is drivingly connected to the first running wheel 3*a* by means of a gear mechanism 9 which is flanged-mounted on the right side part 5*g*. Corresponding to the second embodiment, a first and a second traction mechanism disk 11*a*, 11 *b* are arranged on the rear side of the first side part 5*g* and are drivingly connected by means of corresponding shafts to the first and second running wheels 3*a*, 3*b* arranged on the opposite side of the first side part 5*g*. In this case, the first and second traction mechanism disks 11*a*, 11 *b* are drivingly connected to one another by means of a circumferential traction mechanism 10 designed as a toothed belt. For reasons of clarity, a cover for the traction mechanism 10 and the traction mechanism disks 11*a*, 11 *b* has been omitted from FIG. 7. This cover is arranged between the first side part 5*g* and the gear mechanism 9.

The present invention is generally suitable for use with trolleys 1 for lifting gear of any type and not only for the previously described monorail trolley having a short structural form and chain hoists.

LIST OF REFERENCE SIGNS

1 trolley
2 beam
2*a* travel rail
3*a* first running wheel
3*b* second running wheel
3*c* third running wheel
3*d* fourth running wheel
3*e* running surface
3*f* axle
4 electric drive motor
4*a* motor shaft
5 support frame
5*a* first bearing bracket
5*b* second bearing bracket
5*c* third bearing bracket
5*d* fourth bearing bracket
5*e* first longitudinal beam
5*f* second longitudinal beam
5*g* first side part
5*h* second side part
6*a* first transverse beam
6*b* second transverse beam
7 lifting mechanism
7*a* lifting motor
7*b* lifting gear mechanism
7*c* cable drum
8 electric connection box
9 travel gear mechanism
10 traction mechanism
11*a* first traction mechanism disk
11*b* second traction mechanism disk
12 friction rollers
12*a* lever
12*b* spring element
13 load hook
F direction of travel

The invention claimed is:

1. A trolley for lifting gear, the trolley being designed as a monorail trolley comprising:

a lifting mechanism arranged on a support frame and comprising running wheels which are mounted on the support frame and via which the trolley can be moved on a beam and of which at least one first running wheel is mounted on an axle and the axle can be driven together with the running wheel by means of a drive motor, wherein the drivable first running wheel has a circumferential running surface and the running surface is designed and arranged such that it is in contact with the beam when the trolley moves on the beam, wherein the drivable first running wheel is drivingly connected to at least one of the further running wheels via a traction mechanism such that the axle is arranged between the drive motor and the traction mechanism and thus the traction mechanism is drivingly connected downstream of the axle, so that the traction mechanism can be driven by the axle, and the running surface is in contact with the beam when the trolley moves on the beam outside of the traction mechanism, wherein in each case a traction mechanism disk is drivingly allocated to the driven running wheels and the traction mechanism rotates about the traction mechanism disks, and wherein (i) the driven running wheels and the associated traction mechanism disk are each formed in one piece or (ii) the driven running wheels and the associated traction mechanism disk are drivingly connected to one another in each case by means of a motor shaft or an axle, and wherein the driven running wheels are acted upon via resiliently biased friction rollers in the direction of the beam serving as the travel rail.

2. The trolley as claimed in claim 1, wherein the driven first running wheel and the at least one of the further running wheels are arranged, as seen in the direction of travel of the trolley, one behind the other and on a common side of the beams.

3. The trolley as claimed in claim 2, wherein the at least one of the further running wheels can be driven by the driven first running wheel via the traction mechanism.

4. The trolley as claimed in claim 3, wherein the traction mechanism is designed as a V-ribbed belt.

5. The trolley as claimed in claim 1, wherein the traction mechanism disk adjoins the respective running surface of the driven running wheels.

6. The trolley as claimed in claim 1, wherein the at least one of the further running wheels can be driven by the driven first running wheel via the traction mechanism.

7. The trolley as claimed in claim 6, wherein the traction mechanism is designed as a V-ribbed belt.

8. The trolley as claimed in claim 1, wherein the traction mechanism is designed as a V-ribbed belt.

9. The trolley as claimed in claim 1, wherein the driven running wheels and the associated traction mechanism disk are each formed in one piece and wherein the driven running wheels and the associated traction mechanism disk are drivingly connected to one another in each case by means of a motor shaft or an axle.

10. The trolley as claimed in claim 9, wherein the traction mechanism disk adjoins the respective running surface of the driven running wheels.

11. The trolley as claimed in claim 9, wherein the driven running wheels are acted upon via resiliently biased friction rollers in the direction of the beam serving as the travel rail.

* * * * *